US006334581B1

(12) United States Patent
Lai et al.

(10) Patent No.: US 6,334,581 B1
(45) Date of Patent: Jan. 1, 2002

(54) NOZZLE REPOSITION DEVICE USED IN A RESIST COATING PROCESS

(75) Inventors: Kuei-Hsi Lai, Hsin-Chu Hsien; Hsi-Huang Lee, Hsin-Chu; Hsien-Jung Hsu, Kao-Hsiung; Ching-Chih Cheng, Hsin-Chu Hsien, all of (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/670,386

(22) Filed: Sep. 28, 2000

(51) Int. Cl.[7] ..... B05B 15/08; B05B 1/00; A62C 31/02

(52) U.S. Cl. ..... 239/587.1; 239/587.5; 239/600; 239/589

(58) Field of Search ..... 239/589, 600, 239/587.1, 587.5, 587.2, 69; 222/533, 522, 568; 901/43

(56) References Cited

U.S. PATENT DOCUMENTS 3,107,056 A * 10/1963 Hunter ..... 239/206
4,634,052 A * 1/1987 Grizzle et al. ..... 239/205
4,723,713 A * 2/1988 Dahlquist ..... 239/587
5,088,628 A * 2/1992 Knickerbocker ..... 222/153
5,161,716 A * 11/1992 Knickerbocker ..... 222/152

* cited by examiner

*Primary Examiner*—David A. Scherbel
*Assistant Examiner*—Davis Hwu
(74) *Attorney, Agent, or Firm*—Winston Hsu

(57) ABSTRACT

A spray nozzle resetting device comprises a spray nozzle for spraying resist onto a midpoint of a wafer, a rotary robotic arm that has a resist-delivering duct connected to the spray nozzle, a covering nut, a resetting ring, and a fixing ring. The covering nut has an opening of diameter D. The resetting ring has a rotary part of a diameter less than or equal to D, which fits in the opening of the covering nut, and at least two protrusions. The fixing ring, having two recesses that correspond to the two protrusions and interact with them, is used to connect the covering nut and the rotary robotic arm.

14 Claims, 3 Drawing Sheets

NOZZLE REPOSITION DEVICE USED IN A RESIST COATING PROCESS

BACKGROUND OF INVENTION

1. Field of the Invention

The present invention provides a resist spray nozzle resetting device, namely a device for achieving uniformity of resist coating on a semiconductor wafer.

2. Description of the Prior Art

In semiconductor manufacturing processes, a semiconductor wafer must go through many coating processes from start to finish, such as lithographic resist and developer coating processes. With the narrowing line width in semiconductor processes, photolithographic technology has become critical, for it is with photolithography that all the MOS components, metallic wires, thin film patterns and dopant regions are made. Moreover, the pattern-transferring process, mandatory in photolithography, is complicated and subtle, and so only a precise pattern of resist can ensure the reliability of later processes.

In today's market, most resist coating processes are performed by spin-coating liquid resist over a wafer to form a resist layer with an even thickness. This forms a light-sensitive photo-emulsion layer. Since the uniformity of the thickness of a resist layer can later affect the resolution, the depth of focus (DOF), and even the quality of the wafer, it is important in wafer production to know how to achieve and maintain the uniformity of the resist layer.

Please refer to FIG. 1. FIG. 1 is a front view of a resist coating device 10 according to the prior art. As shown here, the resist coating device 10 comprises a rotary robotic arm 12 and a spray nozzle 14. The spray nozzle 14 has a covering nut 16 fastened on the rotary arm 12. The spray nozzle 14 sprays resist 18 over a wafer's surface 20 which, positioned on a vacuum rotary station 22, is kept in rotating motion. Ideally, the spray nozzle aims straight at the midpoint 26 of the wafer 20; in other words, it forms a line with the central axis 24, so that the resist 18 drops directly on the midpoint 26 of the wafer 20 and coats the wafer surface. Unfortunately, sometimes the spray nozzle 14 might move astray from the center axis 24 due to maintenance errors or operating negligence, causing the resist 18 to fall off the midpoint 26, resulting in a non-uniform resist coating. Even though resetting of the spray nozzle 14 can be done manually, if it is off of the central axis 24, it wastes both time and money, and alignment errors after manual resetting are not negligible.

SUMMARY OF THE INVENTION

The purpose of the present invention is to provide a spray nozzle resetting device to correct the weaknesses of the conventional counterpart described above.

Another purpose of the present invention is to provide a spray nozzle resetting device to avoid misalignment problems, so as to improve the uniformity of the resist layer.

In a preferred embodiment of the present invention, a spray nozzle resetting device comprises a spray nozzle for spraying resist on the midpoint of a wafer, a rotary robotic arm, a resist-delivering duct connected to one end of the spray nozzle, a covering nut, a resetting ring, a fixing ring connecting the covering nut to the rotary robotic arm, and a spring positioned between the covering nut and the resetting ring. The covering nut has an opening of diameter D. The resetting ring has a rotary part with a diameter equal to or less than D, and at last two protrusions. The rotary part fits in the opening of the covering nut. The fixing ring is used to fix the covering nut to the rotary robotic arm, and it has two recesses corresponding to the two protrusions to interact with the two protrusions.

In the preferred embodiment, the midpoint of the resetting ring is not aligned with the two protrusions. To move the spray nozzle, the operator can lift up the rotary part of the fixing ring and rotate it to a desired angle, with the spray nozzle rotating along with it. For performing the resist coating process, the operator can rotate the rotary part in the reverse direction until the two protrusions re-catch on the two recesses, so as to again aim the spray nozzle at the midpoint of the wafer.

DETAILED DESCRIPTION OF THE PREFERRED EMBODIMENT

Figure 1:
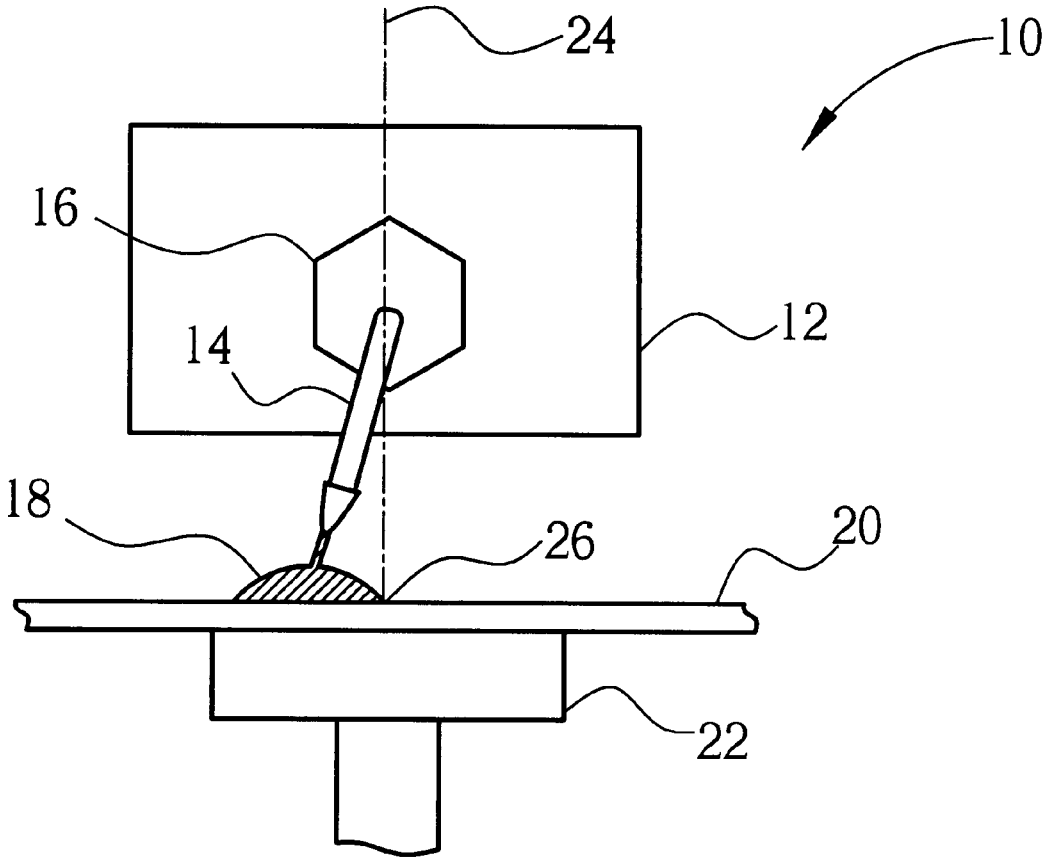
Fig. 1 Prior art
FIG. 1 is a front view of a resist spray nozzle according to the prior art.
Figure 2:
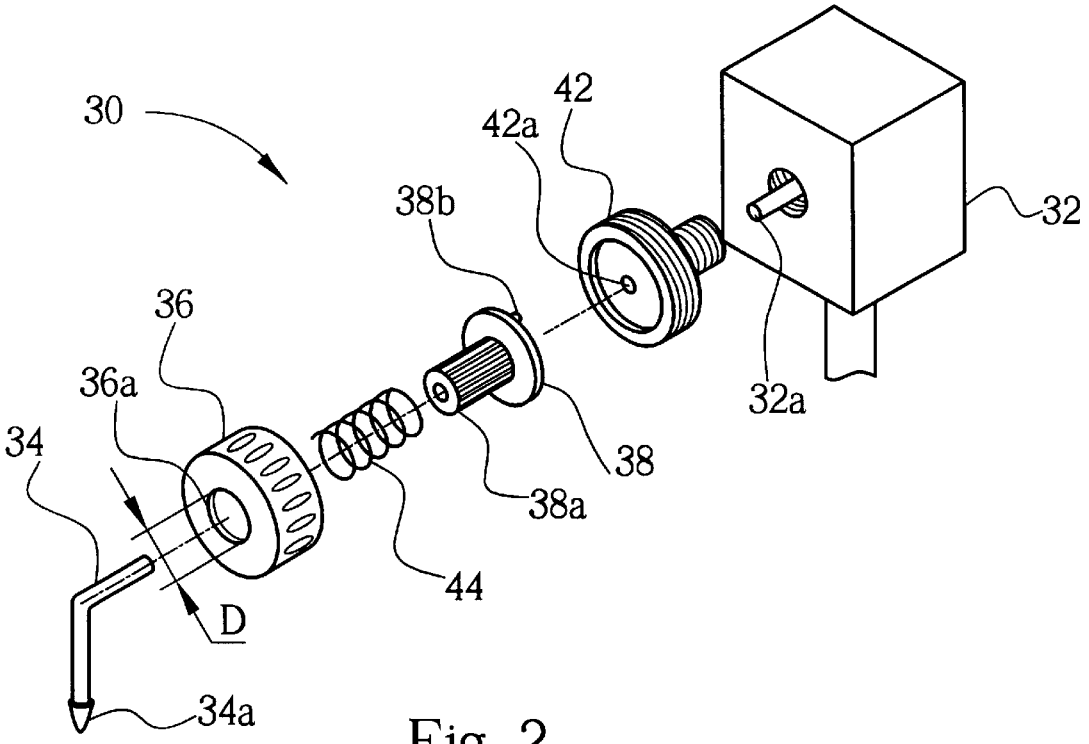
FIG. 2 is an exploded diagram of a spray nozzle resetting device according to the present invention.

Please refer to FIG. 2. FIG. 2 is an exploded diagram of a spray nozzle resetting device 30 according to the present invention. As shown here, the spray nozzle resetting device 30 comprises a spray nozzle 34 bent at a 90 degree angle that is used to spray resist on the midpoint of a wafer, a rotary robotic arm 32 for resist delivery, a covering nut 36 with an opening 36*a* of diameter D, a spring 44, a resetting ring 38 and a fixing ring 42 for connecting the covering nut 36 to the rotary robotic arm 32. The spring 44 is located between the covering nut 36 and the resetting ring 38, and is fixed resiliently on the rotary part 38*a*, providing a tightening force between the resetting ring 38 and the fixing ring 42. The rotary robotic arm 32 has a resist-delivering duct 32*a* connected to one end of the spray nozzle 34.

In the preferred embodiment, the spray nozzle 34 is made of stainless steel, and is bent at 90 degrees. Additionally, the spraying end of the spray nozzle 34 is equipped with a plastic head 34*a*. The spray nozzle 34 of the present invention, however, is not restricted to this particular material and bending angle. Other materials and bending angles can be used for the spray nozzle 34.

Figures 3A, 3B, 3C:
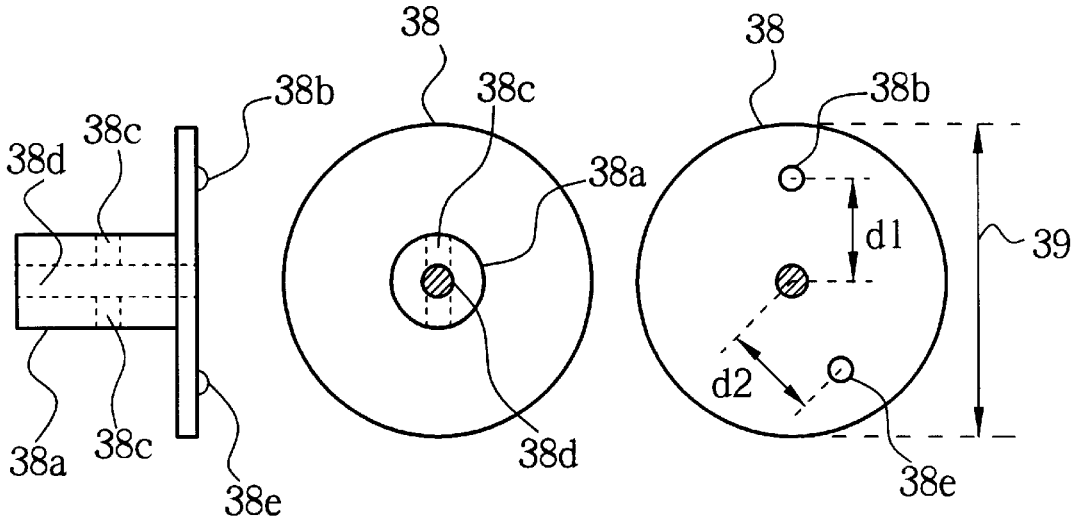
FIG. 3A is a side view of a resetting ring of the present invention.
FIG. 3B is a front view of a resetting ring of the present invention.
FIG. 3C is a rear view of a resetting ring of the present invention.

Please refer to FIG. 3A, which is an enlarged side view of the resetting ring 38 according to the present invention. The resetting ring 38 comprises a rotary part 38*a* on one side, and at least two protrusions 38*b* on the opposite side. The rotary part 38*a* fits into the opening 36*a* of the covering nut 36. Additionally, the rotary part 38*a* has at least one screw hole 38*c* that accommodates a bolt to secure the spray nozzle 34. The resetting ring 38 has in its center a hole 38*d* to accommodate the spray nozzle 34. The hole 38*d* extends through the resetting ring 38, including the rotary part 38*a*. There are in the rotary part 38*a* two screw holes 38*c* going through the hole 38*d* for securing the spray nozzle 34 with a screw bolt, making the spray nozzle 34 and the rotary part 38*a* rotate together.

Please refer to FIG. 3B, which is a front view of the resetting ring 38 according to the present invention. The rotary part 38*a* is located on one side of the resetting ring 38, and the two protrusions 38*b* are on the opposite side. The diameter of the rotary part 38 is equal to or less than D, so that it may pass through the opening 36*a* of the covering nut 36.

"Please refer to FIG. 3C, which is a rear view of the resetting ring 38 according to the present invention The two protrusions 38*b* and 38*e* have distances of d1 and d2 from the center of the circle, respectively. In the preferred embodiment, d1 is not equal to d2, and d1 and d2 are less than the diameter 39 of the resetting ring 38. Additionally, the two protrusions 38*b* and 38*e* are not aligned together with the center point of the circle."

Figures 4A, 4B:
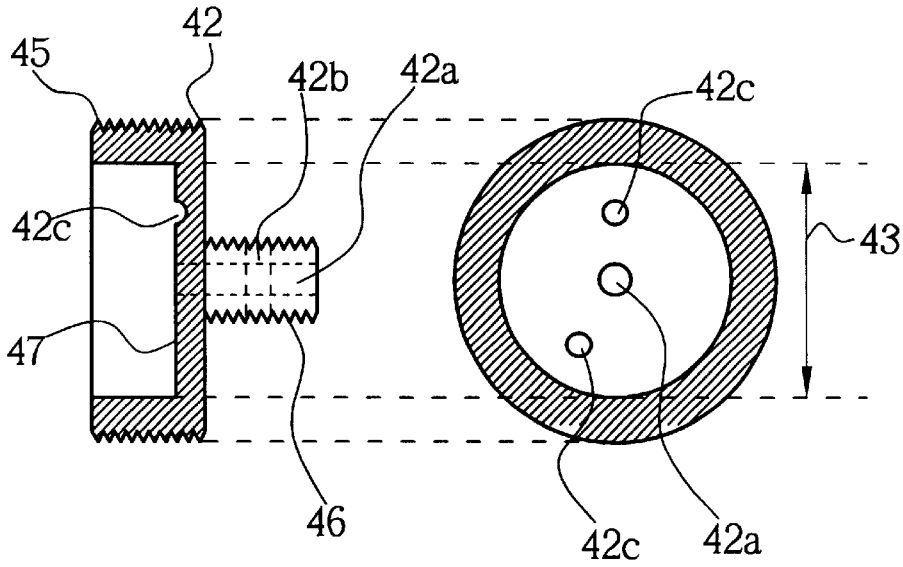
FIG. 4A is a cross-sectional view of a fixing ring of the present invention.
FIG. 4B is a front view of a fixing ring of the present invention.

"Please refer to FIG. 4A and FIG. 4B. FIG. 4A and FIG. 4B are, respectively, a cross-sectional side view and a front view of the fixing ring 42 according to the present invention. As shown in FIG. 4A, the fixing ring 42 comprises a front part 45 and a rear part 46. The front part 45 is screwed tightly to the covering nut 36, and the rear part 46 to the rotary robotic arm 32. In other words, the main function of the fixing ring 42 is to join together the covering nut 36 and the rotary robotic arm 32. Moreover, the fixing ring 42 has in its center an opening 42*a* that accommodates the spray nozzle 34 and the resist-delivering duct 32*a*. There are two screw holes 42*b* in the rear part 46 for securing the resist-delivering duct 32*a*, which runs across the rear part."

The fixing ring 42 has an the inner side 47 of the rear part 45 two recesses 42*c*, which correspond to and interact with the two protrusions 38*b* of the resetting ring 38. In the preferred embodiment, the center point of the fixing ring 42 is not aligned with the two recesses 42*c*. As shown in FIG. 3C and FIG. 4B, the diameter 43 of the inner circle of the front part 45 of the fixing ring 42 is slightly longer than the diameter 39 (in FIG. 3C) of the resetting ring 38.

What is worth noticing is that because the distances d1 and d2 from the two protrusions 38*b* and 38*c* to the center point of the circle, respectively, are not the same, and because the two protrusions 38*b* and 38*c*, and the center point of the resetting ring 38 are not aligned, the spray nozzle can have only one reset position.

Figure 5:
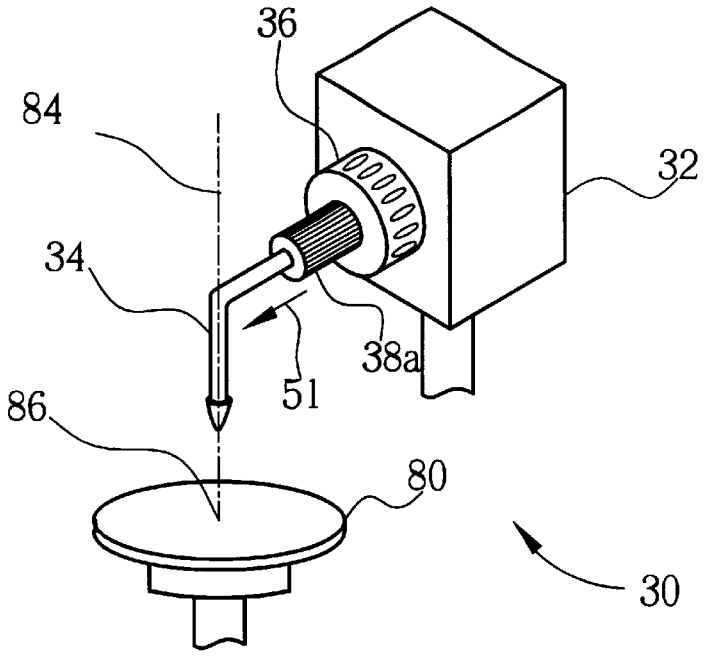
FIG. 5 is a perspective view of a spray nozzle resetting device according to the present invention.

Please refer to FIG. 5, which is a perspective view of the spray nozzle resetting device 30 according to the present invention. As shown here, to move the spray nozzle 34 for regular maintenance, the operator first pulls out the rotary part 38*a* in the direction of the arrow 51, and rotates it clockwise or counter clockwise through an angle. Since the spray nozzle 34 has been screwed securely to the rotary part 38*a*, the spray nozzle 34 moves together through the same angle as the rotary part 38*a*. When the operator releases the rotary part 38*a*, the resetting ring 38 and the fixing ring 42 are kept in contact by the force provided by he spring 44, allowing the spray nozzle 34 and the resetting device 30 to remain in the maintenance position. After the maintenance procedure has been completed, and when the operator needs to run another resist coating process, he or she may rotate the rotary part 38*a* in the reverse direction until the two protrusions 38*b* re-catch the two recesses 42*c*, ensuring that the spray nozzle 34 points at the midpoint 86 of the wafer 80, and aligning it with the center axis.

It should be remembered that before using the spray nozzle resetting device 30, the operator should correct the spray nozzle 34 by aiming it at the midpoint 86 of the wafer 80 and aligning it with the center axis 84. It is only after the correction that the operator may secure with screw bolts the spray nozzle 34 to the rotary part 38*a* of the resetting ring 38. In this manner, the operator ensures that the spray nozzle points precisely at the midpoint 86 of the wafer 80 for each run.

In comparison to the prior art, the present invention is superior in that it solves the resetting problem of the spray nozzle 34, which the operator often encounters after a maintenance procedure. Because of this invention, the spray nozzle 34 can now be accurately aimed at the midpoint 86 of the wafer 80 in resist coating processes, thus improving the uniformity of resist and the reliability of the later photolithographic processes.

The above disclosure is based on the preferred embodiment of the present invention. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A resist spray nozzle reposition device comprising:

a spray nozzle with an approximately rectangular shape being used to spray resist onto a midpoint of a spinning semiconductor wafer;

a rotary robot arm comprising a resist-transmitting line, the resist-transmitting line connected to an end of the spray nozzle;

a covering nut having an opening with a diameter D;

a reposition ring comprising a rotary part with a diameter less than or equal to D, and at least two protrusions, the rotary part positioned through the opening of the covering nut;

a fixing ring used to connect the covering nut and the rotary robot arm, the fixing ring comprising two recesses that are positioned to correspond with the two protrusions; and a spring used to provide a force to keep the reposition ring in tight contact with the fixing ring, the spring being positioned between the covering nut and the reposition ring;

wherein to move the spray nozzle, the rotary part of the reposition ring is pulled out against the force of the spring and rotated together with the spray nozzle by an angle, and by continuing to rotate the rotary part, the spray nozzle can be self-aligned and repositioned on the midpoint of the semiconductor wafer due to interaction between the protrusions and the recesses.

2. The spray nozzle reposition device of claim 1 wherein at least one screw is used to fix the spray nozzle on the rotary part of the reposition ring so that the spray nozzle and the rotary part are rotated together.

3. The spray nozzle reposition device of claim 1 wherein the spray nozzle has a right-angled shape.

4. The spray nozzle reposition device of claim 1 wherein the spray nozzle is made of stainless steel.

5. The spray nozzle reposition device of claim 1 wherein the spray nozzle further comprises a plastic head positioned on another end of the spray nozzle.

6. The spray nozzle reposition device of claim 1 wherein a midpoint of the reposition ring is not aligned with the two protrusions.

7. The spray nozzle reposition device of claim 1 wherein a midpoint of the fixing ring is not aligned with the two recesses.

8. A liquid process spray nozzle reposition device used in the manufacturing of semiconductor devices, the liquid process spray nozzle reposition device comprising:

a spray nozzle with an approximately rectangular shape;

a rotary robot arm comprising a liquid-transmitting line, the liquid-transmitting line connected to an end of the spray nozzle;

a covering nut having an opening with a diameter D;

a reposition ring comprising a rotary part with a diameter less than or equal to D, and at least two protrusions;

a fixing ring used to connect the covering nut and the rotary robot arm, the fixing ring comprising two recesses that are positioned to correspond to the two protrusions; and a spring that provides a force to keep the reposition ring tightly in contact with the fixing ring, the spring being positioned between the covering nut and the reposition ring.

9. The spray nozzle reposition device of claim 8 wherein at least one screw on the rotary part of the reposition ring fixes the spray nozzle so that the spray nozzle and the rotary part are rotated together.

10. The spray nozzle reposition device of claim 8 wherein the spray nozzle has a right-angled shape.

11. The spray nozzle reposition device of claim 8 wherein the spray nozzle is made of stainless steel.

12.The spray nozzle reposition device of claim 8 wherein the spray nozzle further comprises a plastic head positioned on another end of the spray nozzle.

13. The spray nozzle reposition device of claim 8 wherein a midpoint of the reposition ring is not aligned with the two protrusions.

14. The spray nozzle reposition device of claim 8 wherein a midpoint of the fixing ring is not aligned with the two recesses.

* * * * *